US007847248B2

(12) United States Patent
Collings

(10) Patent No.: US 7,847,248 B2
(45) Date of Patent: Dec. 7, 2010

(54) METHOD AND APPARATUS FOR REDUCING SPACE CHARGE IN AN ION TRAP

(75) Inventor: Bruce A. Collings, Bradford (CA)

(73) Assignees: MDS Analytical Technologies, a business unit of MDS Inc., Concord (CA); Applied Biosystems, Inc., Framingham, MA (US)

( * ) Notice: Subject to any disclaimer, the term of this patent is extended or adjusted under 35 U.S.C. 154(b) by 213 days.

(21) Appl. No.: 12/272,998

(22) Filed: Nov. 18, 2008

(65) Prior Publication Data

US 2009/0166534 A1 Jul. 2, 2009

Related U.S. Application Data

(60) Provisional application No. 61/017,203, filed on Dec. 28, 2007.

(51) Int. Cl.
*H01J 49/42* (2006.01)

(52) U.S. Cl. ..... 250/292; 250/282

(58) Field of Classification Search ..... 250/292, 250/282

See application file for complete search history.

(56) References Cited

U.S. PATENT DOCUMENTS

| | | | | |
|---|---|---|---|---|
| 6,177,668 | B1 * | 1/2001 | Hager | 250/282 |
| 6,867,414 | B2 | 3/2005 | Buttrill, Jr. | |
| 6,881,352 | B2 | 4/2005 | Kagoshima et al. | |
| 7,312,442 | B2 * | 12/2007 | Hansen | 250/282 |
| 7,372,024 | B2 * | 5/2008 | Mordehai et al. | 250/292 |
| 7,378,653 | B2 * | 5/2008 | Wells | 250/292 |
| 7,446,310 | B2 * | 11/2008 | Kovtoun | 250/282 |
| 7,498,569 | B2 * | 3/2009 | Ding | 250/282 |
| 2004/0011956 | A1 * | 1/2004 | Londry et al. | 250/292 |

FOREIGN PATENT DOCUMENTS

| | | |
|---|---|---|
| KR | 100199835 | 6/1999 |

* cited by examiner

*Primary Examiner*—Jack I Berman
(74) *Attorney, Agent, or Firm*—Harness, Dickey & Pierce, PLC

(57) ABSTRACT

Ion trap apparatus and methods for efficiently addressing the effects of charge space caused by ion trap overfilling, useful in linear ion traps of mass spectrometers.

25 Claims, 8 Drawing Sheets

METHOD AND APPARATUS FOR REDUCING SPACE CHARGE IN AN ION TRAP

CROSS-REFERENCE TO RELATED APPLICATIONS

Figure 1:
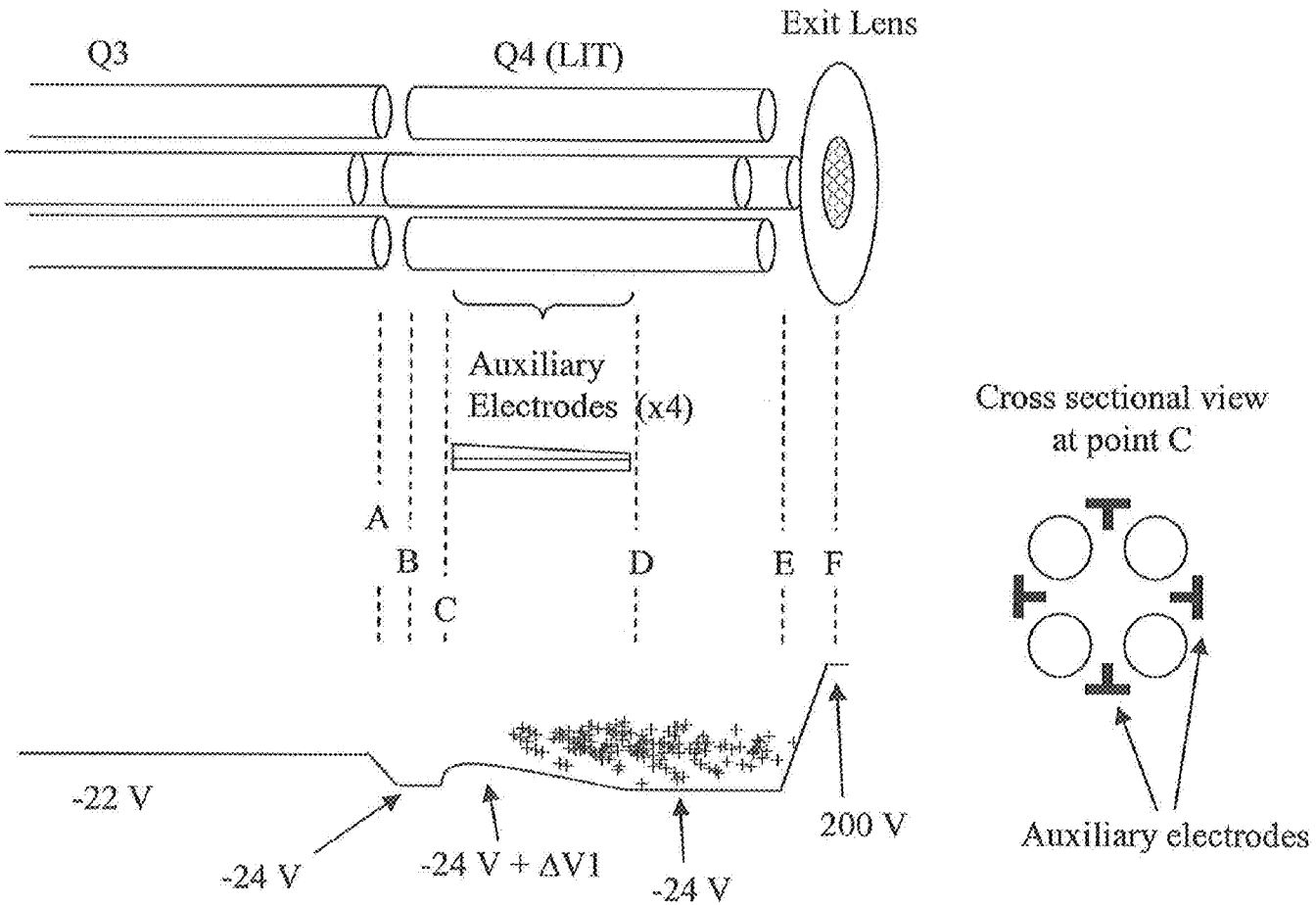

This application claims the benefit of U.S. Provisional Application No. 61/017,203 filed on Dec. 28, 2007. The entire disclosure of the above application is incorporated herein by reference.

INTRODUCTION AND SUMMARY

Ion traps, such as those employed in mass spectrometers, are widely used in analytical techniques. One issue that is common to all ion trapping systems is excess space charge, resulting from relative overfilling of the ion trap, and the interference that is exhibited as a result of space charge, whereby the mass spectrum obtained from the trapped ions becomes distorted. Such distortion particularly pronounced in some trap scan techniques. In mass spectrometers, such as the 4000 Q Trap system (Applied Biosystems), the trap scan mode that suffers most from space charge is the enhanced mass spectrum (EMS) mode; and to a lesser extent space charge problems are also encountered in the enhanced resolution (ER) mode.

As mass spectrometry methods continue to evolve, one recent approach to improve analytical efficiency, with improved resolution, has been to develop brighter ion sources to improve the sensitivity. Yet, as brighter ion sources are created and their use becomes more widespread, the need for handling the associated increase in space charge grows more critical. Some approaches that have been employed to avoid such space charge effects include minimizing the fill time of the ion trap, and/or reducing the duty cycle of the ion beam from the source by modulating the potential to an ion optic upstream of the ion trap, i.e. pulsing or defocusing the ion optic. However, none of these is a solution that permits efficient analysis in every case. As a result, it would be advantageous to provide additional or alternative methods and apparatus for addressing ion trap space charge.

In various embodiments, the present disclosure describes a different technique for addressing space charge effects in ion traps. This technique is based upon the observation that trapping potentials within a LIT can be manipulated to remove excess ions and thereby decrease the risk that a particular analytical run will suffer from space charge effects. In various embodiments, upon first filling of the LIT, a smaller trapping potential is produced within the LIT; then the excess ions are allowed to exit the LIT; and next the normal trapping conditions are reestablished, prior to further manipulating and/or scanning ions out of the LIT for collection of the mass spectrum. The present disclosure further provides:

Mass spectrometry apparatus having (1) a first quadrupole, an exit lens, and a linear ion trap disposed between the first quadrupole and the exit lens, the linear ion trap having a well-modulator quadrupole containing at least two differently potentiated zones, defining at least two different sectors of the linear ion trap such that the linear ion trap is capable of being operated to form potential wells, alternately or simultaneously, in at least two different sectors of the linear ion trap, the sectors including a proximal sector nearer the first quadrupole and a distal sector nearer the exit lens, wherein the linear ion trap is capable of operation whereby an ion population can be loaded from the first quadrupole into a well formed in the distal sector and, by manipulation of the potentials of differently potentiated zones of the well-modulator quadrupole, some of those ions can be transferred back to the first quadrupole by passage through a well formed in the proximal sector, the proximal sector well retaining a fraction of those ions, thereby preventing overfilling of the linear ion trap. See, e.g., FIGS. 3A-3D.

Such apparatus further including a programmable controller operably coupled to the linear ion trap, and that is programmed with an algorithm having instructions for the controller to manipulate the potentials of the sectors of the linear ion trap, at levels below the potential of the exit lens, by:

(1) holding the linear ion trap at a potential lower than the potential of the first quadrupole and with a potential well at a distal sector of the linear ion trap that has a potential less than the potential of a proximal sector thereof, thereby permitting transfer of ions from the first quadrupole to the linear ion trap;

(2) raising the potential of the linear ion trap to a level higher than the potential of the first quadrupole, and decreasing the potential of the proximal sector to form a proximal sector well defined in part by a higher potential wall at its upstream end, and (3) raising the potential of the distal sector well to a level that is about the same as or greater than that of the wall, thereby transferring ions from the distal sector well to the first quadrupole and transferring a fraction of the ions from the distal sector well to the proximal sector well.

Such apparatus in which the algorithm further includes instructions to (4) after step (3), raise the potential of the proximal sector, or decrease the potential of the distal sector, to transfer ions from the proximal sector to the distal sector; such apparatus in which the algorithm further includes instructions to (5) after step (4), scan ions out of the linear ion trap for detection at a detector.

Such apparatus in which the algorithm further includes instructions to repeat steps (1)-(3) to allow loading and processing of ions retained in the first quadrupole as a result of having been transferred back to there as a result of step (3).

Such apparatus in which the programmable controller is further operably coupled to the first quadrupole, and the controller is programmed with an algorithm including instructions for the controller to manipulate the potential(s) thereof.

Such apparatus in which the well-modulator quadrupole includes an auxiliary-electrode-supplemented quadrupole rod set having one trap quadrupole rod set and at least one set of four shorter auxiliary electrodes, shorter than the rods of the trap quadrupole, each shorter electrode being disposed substantially parallel to the other shorter electrodes of its set and being located in a space between a different pair of rods of the quadrupole, the shorter electrodes of a set being located axially equidistantly from the plane of the exit lens and radially equidistantly from the central axis of the trap quadrupole, to form a short, linear zone within the linear ion trap quadrupole, and each set of auxiliary electrodes being electrically potentiated independently of other elements of the linear ion trap, thereby defining at least two differently potentiated zones along the trap quadrupole rod set.

Such apparatus in which the well-modulator quadrupole includes a segmented quadrupole of at least two segments, wherein each segment is electrically potentiated independently of other elements of the linear ion trap, thereby defining at least two differently potentiated zones along the segmented quadrupole.

A method for mass spectrometry, involving (I) providing a mass spectrometry apparatus having a linear ion trap located between a first quadrupole of the device and the exit lens thereof, the linear ion trap including at least two sectors, including a proximal sector nearer the first quadrupole and a distal sector nearer the lens, each of the sectors being electrically potentiated differently from the other, (II) operating the mass spectrometer to transfer ions from the first quadrupole to the linear ion trap, (III) trapping transferred ions in a first sector of the linear ion trap that is maintained at a lower potential than that of the regions of the linear ion trap adjacent thereto, (IV) adjusting the potentials within the linear ion trap to transfer ions from the trapping sector to the adjacent first quadrupole and to retain a fraction of the ions in a second sector of the trap that is maintained at a lower potential than that of its adjacent regions in the linear ion trap, the second sector being the same as or different from the first sector in step (III).

Such methods in which the transferring in step (II) involves maintaining the potentials of (1) the linear ion trap and (2) the portion of the first quadrupole that is adjacent to linear ion trap, so that the adjacent portion has a higher potential than that of linear ion trap.

Such methods further involving (V) scanning the fraction of ions of step (IV) out of the linear ion trap and detecting ions released therefrom, the method thereby substantially reducing space charge interference in the detection of an ion of interest from the released ions.

Such methods in which, in step (IV), the second sector is different from the first sector. Such methods in which, in step (IV), the second sector is a proximal sector and the first sector is a distal sector of the linear ion trap.

Such methods in which the ions transferred in step (IV) from the trapping segment of linear ion trap to the first quadrupole are retained in that quadrupole, and the method further involves transferring retained ions, after the linear ion trap has been scanned to empty it of ions, to the linear ion trap and repeating steps (III) and (IV).

Such methods further involving (V) scanning the fraction of ions of step (IV) out of the linear ion trap and detecting ions released therefrom, the method thereby substantially reducing space charge interference in the detection of an ion of interest from the released ions.

Such methods in which steps (IV) and (V) are repeated one or more times until there are no more ions left in either the first quadrupole or the linear ion trap.

Such methods in which the manipulating in step (IV) involves adjusting the potential of the linear ion trap, the potential of the portion of the first quadrupole that is adjacent to linear ion trap, or adjusting both, so that the adjacent portion has a lower potential that than of linear ion trap.

Such methods in which, after the adjustment of the potential(s), the potential of the adjacent portion of the first quadrupole is at least 500 mV lower than that of the linear ion trap. Such methods in which, after the adjustment of the potential(s), the potential of the adjacent portion of the first quadrupole is about 20 V or more lower than that of the linear ion trap.

Such methods in which the exit lens is maintained at a potential that is sufficiently greater than that of the potential of the remaining elements of the LIT such that ions are inhibited from exiting the lens prematurely. Such methods in which the exit lens is maintained at a potential that is about 200 V greater than the potential of the linear ion trap.

Such methods in which the mass spectrometry apparatus is a triple quadrupole mass spectrometer and the first quadrupole comprises Q3.

Such methods in which the first sector of step (III) or the second sector of step (IV) is maintained at a potential that is at least or about 0.05 V lower than the remainder of the linear ion trap.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 1 illustrates an embodiments of an auxiliary-electrode-supplemented version of a well-modulator linear ion trap (LIT), situated between quadrupole 3 (Q3) of a triple quadrupole mass spectrometer and the exit lens thereof. The illustrated potential profile shows exemplary potentials applied to the optics for filling the LIT.

Figure 2:
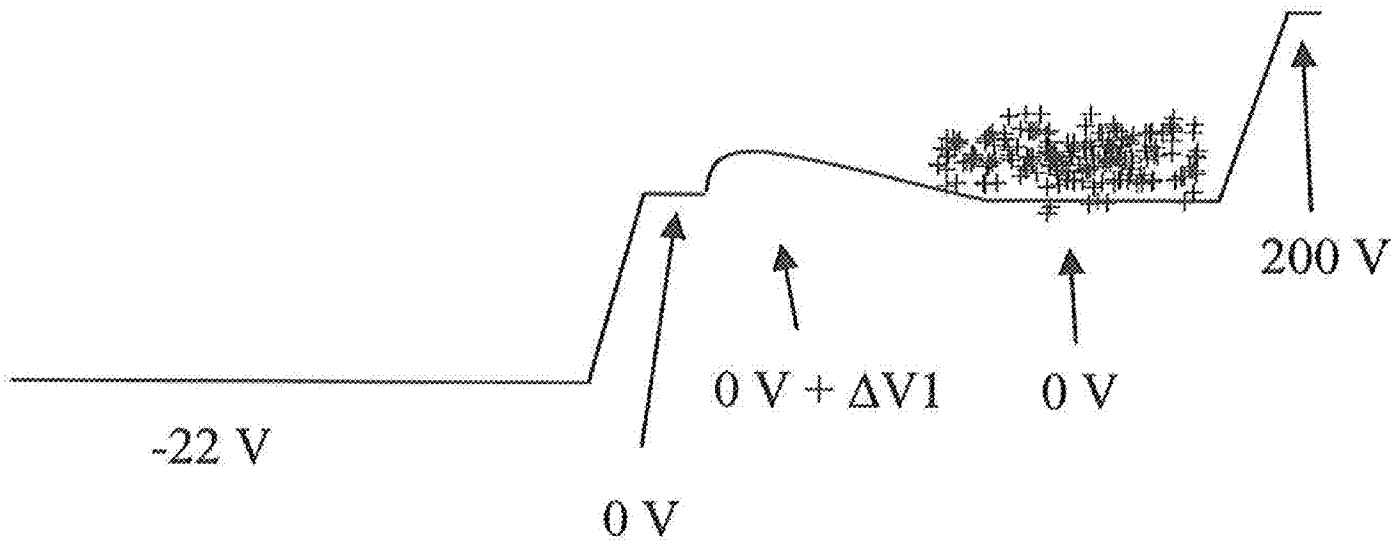

FIG. 2 presents a potential profile illustrating potentials applied to the LIT immediately prior to lowering the exit lens potential for scanning ions out of the LIT. Q3 is shown maintained at −22V.

Figure 3:
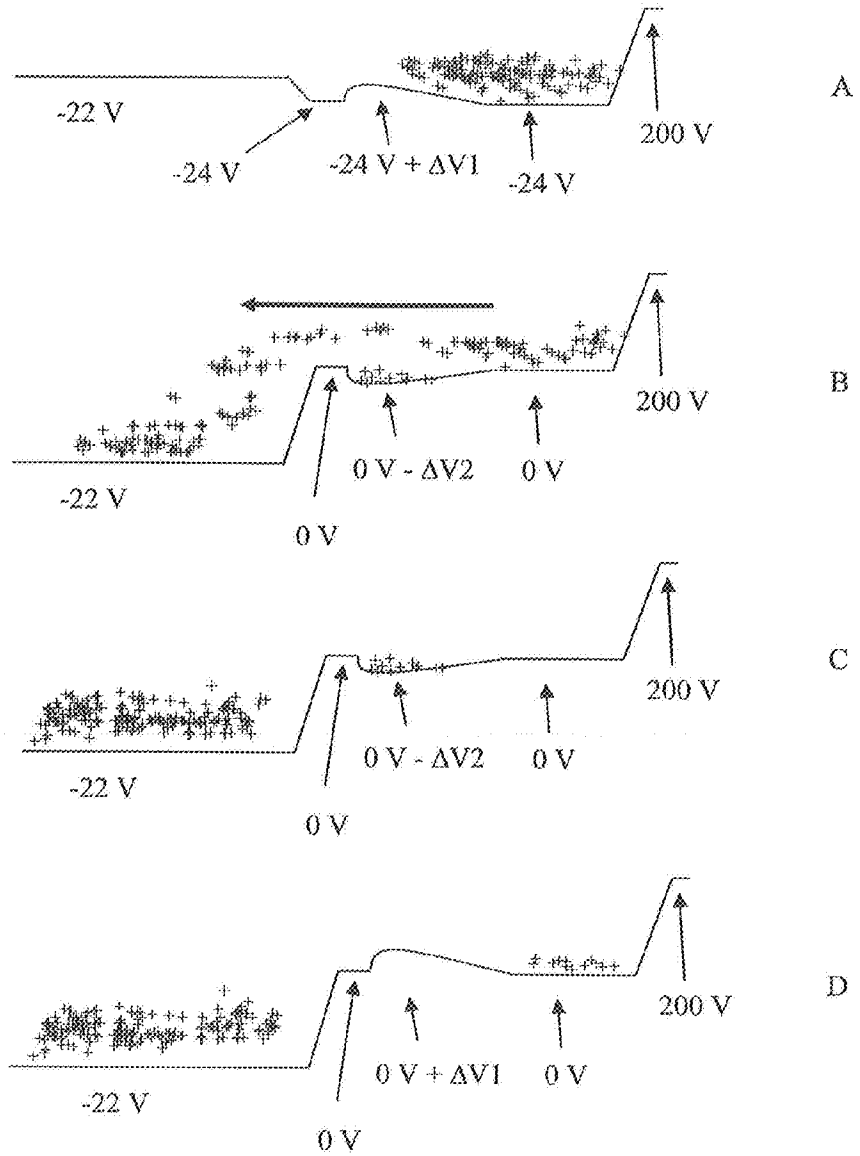

FIG. 3, i.e. FIGS. 3A-3D, illustrates a series of potential profiles showing an exemplary embodiment in which potentials are applied to limit the number of ions in the LIT. Q3 is shown maintained at −22V. FIG. 3A shows potentials as applied according to the illustration of FIG. 1, after the LIT has been filled for a period of time. In this step a large number of ions have been admitted to the LIT. In the next step, FIG. 3B, the potential on the auxiliary electrodes is increased from 200 V to −20 V while the potential offset of the LIT is raised to 0 V. This results in the formation of a small trapping potential in the region of the auxiliary electrodes. All of the ions cannot fit into this trapping potential and, as a result, a fraction of the ions flow back to the Q3 region, which remains at a lower potential offset. This results in two distinct populations of ions in two separate trapping zones. This is shown in FIG. 3C. In the next step the potential applied to the auxiliary electrodes is increased back to 200 V, forcing the ions in the small trapping potential to move towards the exit lens at the right, as shown in FIG. 3D. The potentials on the LIT are now at the potentials used in the step just prior to scanning the ions out of the LIT. The primary difference between FIG. 2 and FIG. 3D is the reduced number of ions in the LIT.

Figure 4A:
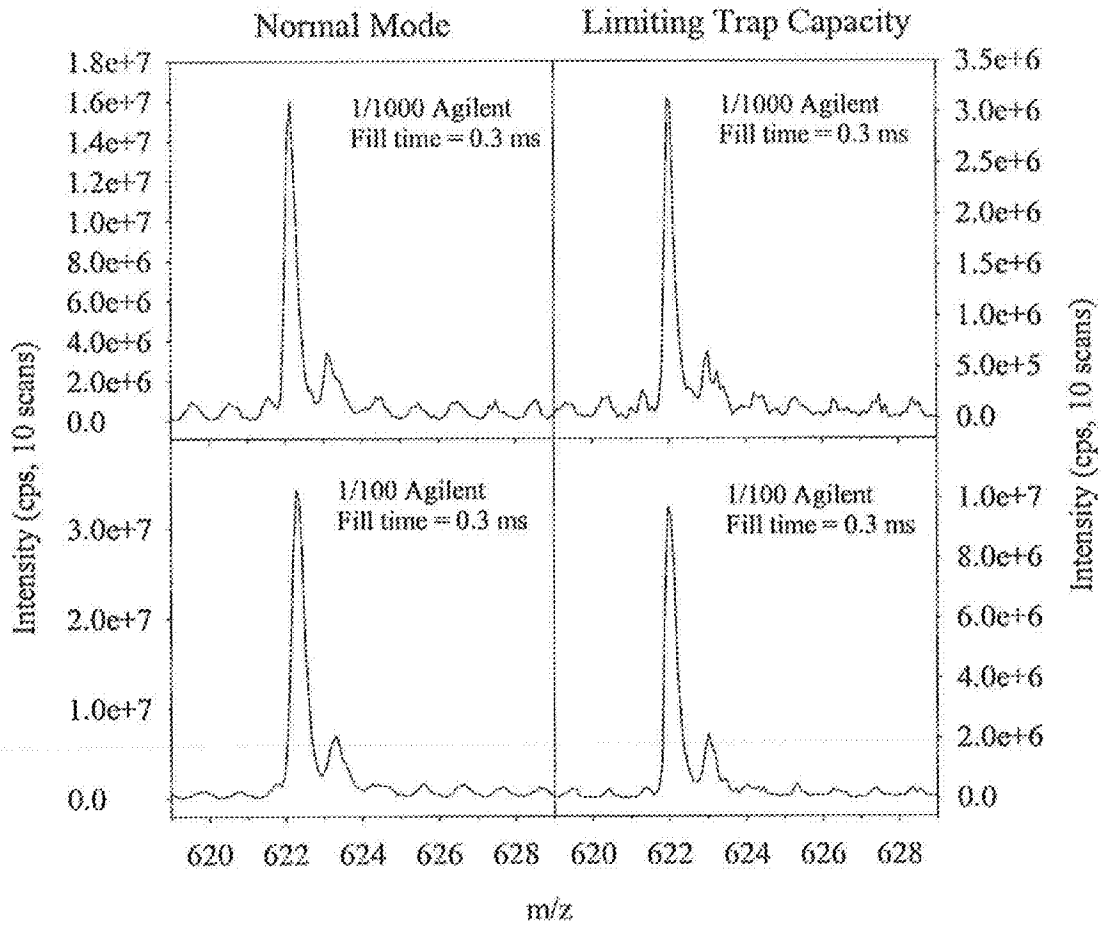
Figure 4B:
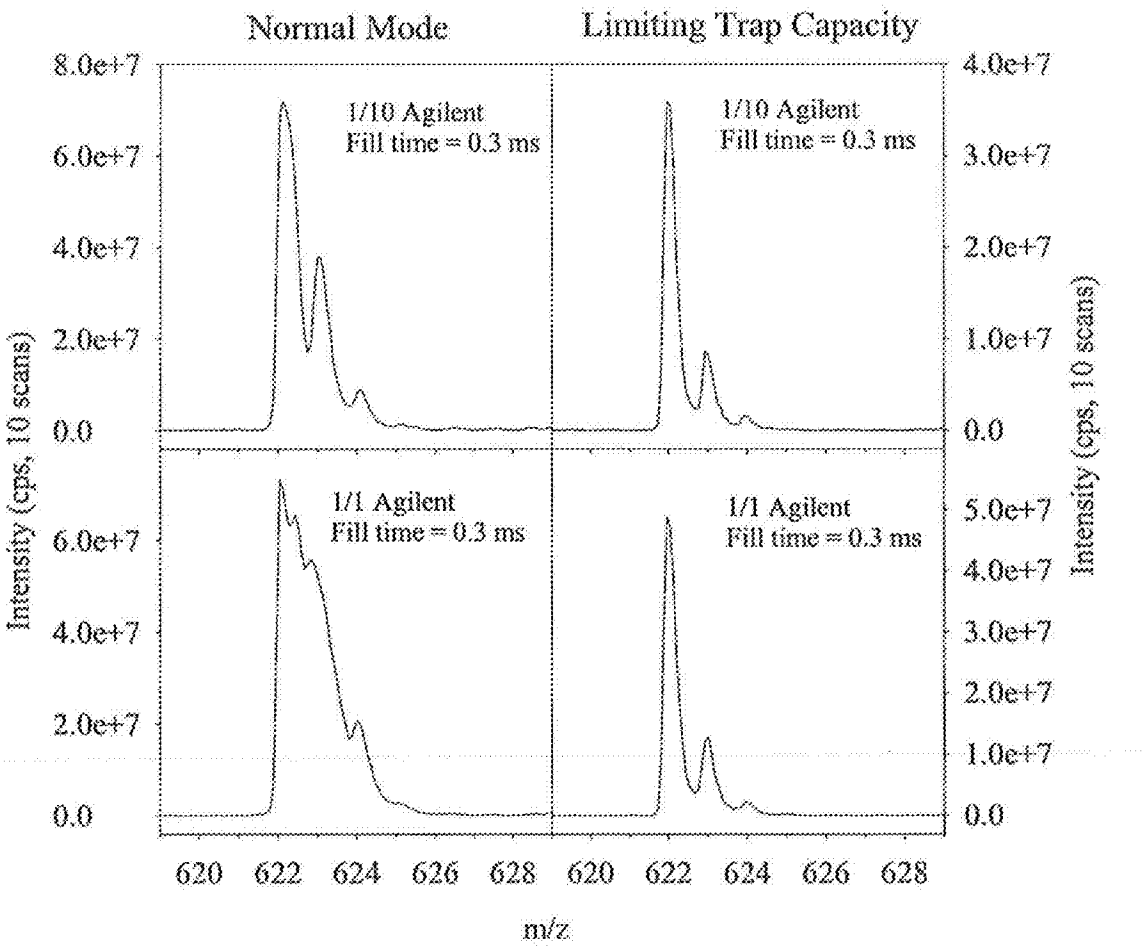

FIG. 4, i.e. FIGS. 4A and 4B, presents mass spectra for the 622 m/z ion obtained from an Agilent tuning mixture. The left column of both figures shows the mass spectrum obtained using the normal trap filling sequence illustrated in FIGS. 1 and 2. The right column shows mass spectra obtained using the filling sequence illustrated in FIG. 3, in which the capacity of the LIT has been effectively limited by operation of the well-modulator quadrupole. Four dilutions of the Agilent tuning solution were used with the dilution noted in each figure. The fill time in each case was set to 0.3 ms. The benefits of the new technique are clearly demonstrated for the 1/10 and 1/1 dilutions shown in FIG. 4B.

Figure 5:
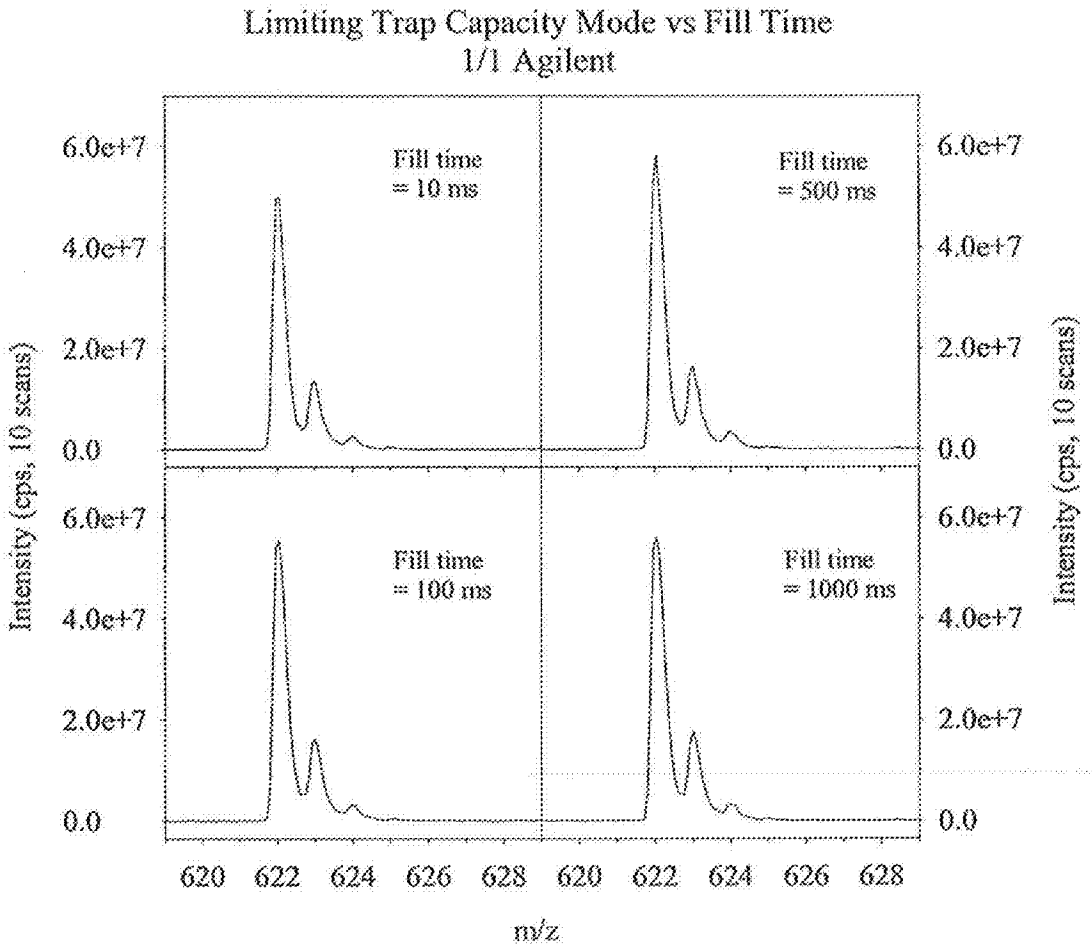

FIG. 5 presents mass spectra for 622 m/z as a function of trap fill time from 10 to 1000 ms. The undiluted sample was used to obtain the data. There are no signs of space charge interference in the data.

Figure 6:
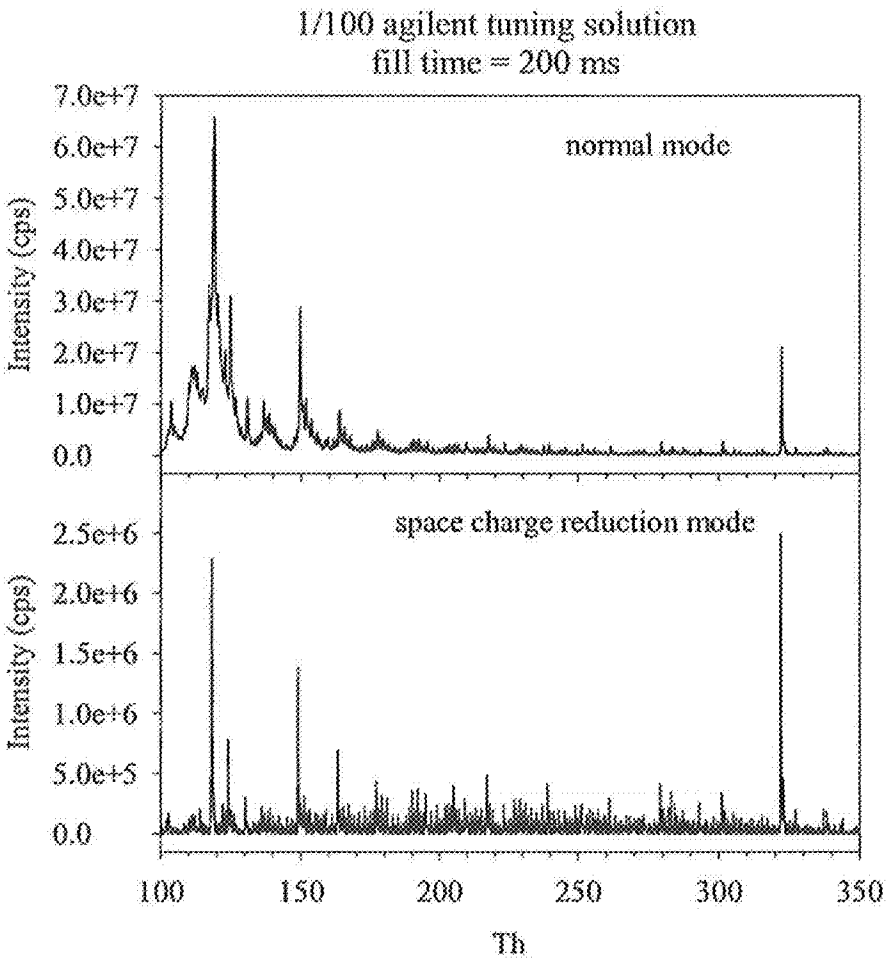

FIG. 6 shows an exemplary mass spectrum obtained using a traditional fill procedure (top frame) and another obtained using an embodiment of the procedure disclosed herein (bottom frame). For both, a 1/100 dilution of the Agilent tuning solution was used and the fill time in each case was set to 200 ms. The mass range was 100 to 350 m/z, demonstrating that the present technique can be employed over a wide mass range.

Figure 7:
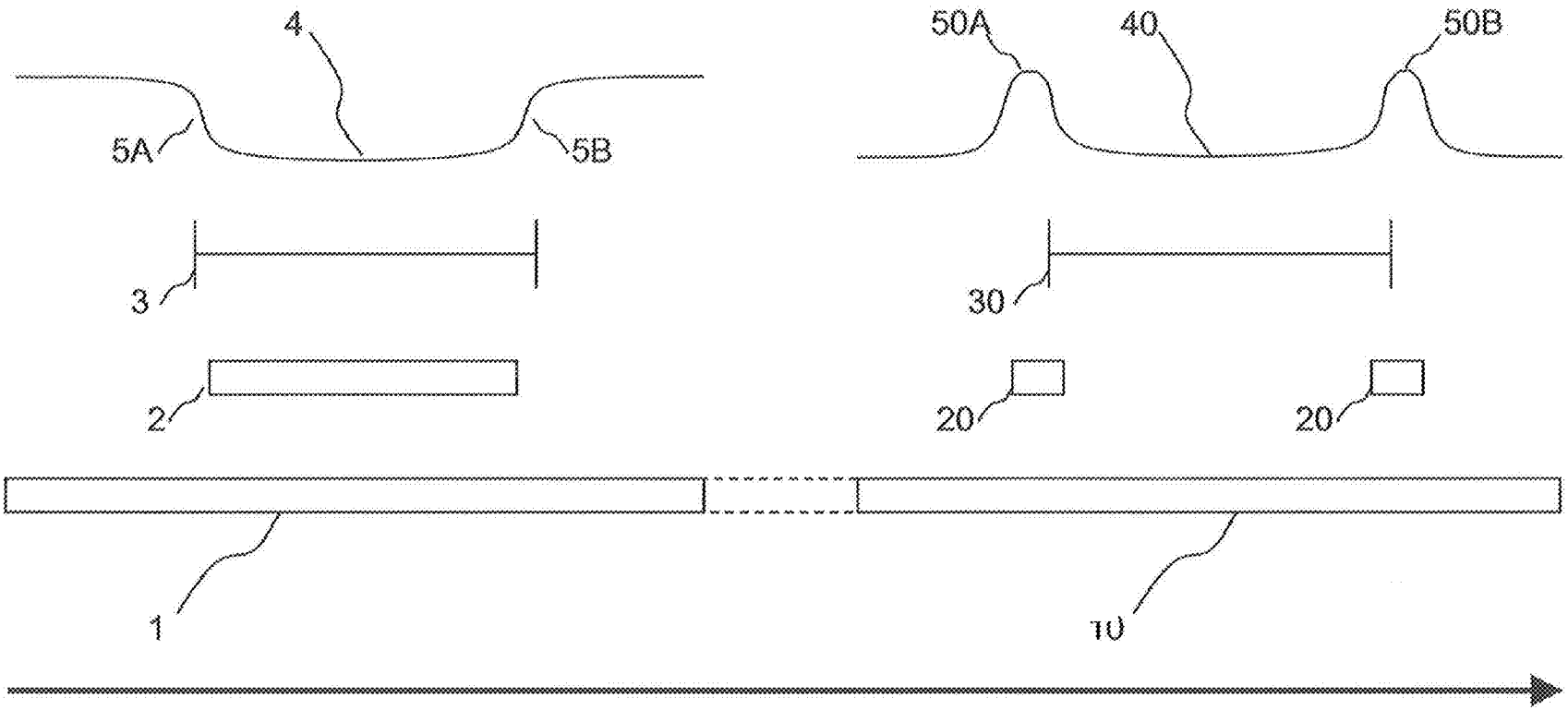

FIG. 7 illustrates two exemplary formats in which potential wells can be created in a linear ion trap hereof. Linear ion trap quadrupole element(s) (1, 10) include differently potentiated zones (2, 20) defining sectors (3, 30) of the LIT in which potential wells (4, 40) can be formed. Dashed lines show that the illustrated formats can be present in the same or different LIT quadrupole assemblage(s). An arrow illustrates a direction for ion flow from LIT entry to LIT exit, and in light of that direction, the wells are shown defined by upstream (5A, 50A) and downstream (5B, 50B) walls. These depictions are non-limiting; e.g., walls defining a potential well can be of the same or different potentials, and different wells within a well-modulator quadrupole can have the same or different potentials. The depth of a given well or height of given wall can likewise be changed during any given ion analysis, and in various embodiments, these features are only temporarily present in the LIT during the analysis.

DETAILED DESCRIPTION

The following description is merely exemplary in nature and is not intended to limit the present disclosure, application, or uses.

An approach employed herein utilizes an ion trap in which one or more regions of low potential, lower than that of other elements of the ion trap, can be formed. In various embodiments in which the ion trap is a quadrupole-based ion trap, a method hereof can utilize a "well-modulator quadrupole".

Thus, as used herein to describe elements of some embodiments of a linear ion trap hereof, the term "well-modulator quadrupole" refers to a quadrupole assemblage having, or supplemented to have, at least two different zones of potentiation. These different zones are capable of exhibiting different degrees of potentiation either because they are or comprise independently potentiated elements, such as independently potentiated electrode segments or independently potentiated auxiliary electrodes, or because they comprise different materials, such as a bare electrode surface versus a resistively-coated electrode surface, or segments of different materials in a segmented quadrupole, e.g., an alternating electrode/insulator where the insulator is not highly "visible" to the ions, such as a ceramic rod set that is coated in gold, except for thin bands without gold (e.g., which bare bands can be formed through laser ablation of the gold coating). Thus, a well-modulator quadrupole hereof can comprise an auxiliary-electrode-supplemented quadrupole, a segmented quadrupole, a quadrupole having resistively-coated rods, or any other configuration that provides the different zones of potentiation.

A potential well formed within a well-modulator quadrupole hereof is formed by maintaining a zone of potentiation within the LIT at a potential lower than the potential(s) of the regions of the LIT adjacent to that zone; in some embodiments, a potential well can be formed by maintaining a zone of potentiation within the LIT at a potential lower than the potential(s) of the remainder of the LIT. FIG. 7 illustrates two different formats in which a potential well can be obtained within a linear ion trap. Such wells can be formed by decreasing the potential of a differently potentiated zone of the LIT, or by raising the potential(s) of the adjacent zone(s), or both.

Each well is defined by its having a lower potential than the potential(s) of the adjacent regions of the LIT. Each such region of higher potential can be referred to herein as a "potential wall." Each well can have one such "upstream" wall, distal from the LIT exit lens, and one such "downstream" wall, proximal to the exit lens. Similarly, each well and each LIT zone capable of being manipulated to form a well therein (e.g., subtended thereby), can be said to have an upstream end and a downstream end.

As suggested above, in various embodiments hereof, a well-modulator quadrupole is used in a linear ion trap, e.g., the linear ion trap of a mass spectrometer, such as a triple-quadrupole (QqQ) mass spectrometer. In such an embodiment, the rods of a linear ion trap quadrupole can have a cross section that is circular, elliptical, oval, hyperbolic, or any other geometry useful in the art of linear ion traps. The rods are regularly disposed radially about the central axis of the linear ion trap (LIT). Where the rods have a cross-section having a tapered end, that tapered end is typically oriented toward the central axis of the linear ion trap, although other orientations can be used.

An electrode can also or alternatively have a tapered profile along its length, such that when a potential is applied thereto, it produces an axial gradient along the length of the electrode, e.g., along the length of the quadrupole. Where used, sets of two or four of the tapered electrode(s) are typically placed between the rods of the quadrupole to permit an axial gradient to be produced along the quadrupole. In various embodiments, a combination of two tapered, e.g., linac, electrodes and two non-tapered T bars in the same zone of the LIT can be employed. In such an embodiment, the non-tapered T bars provide the shallow well, while the tapered profile electrodes move the ions from the well to the exit end of the LIT, in different steps of a method hereof.

In some embodiments, a LIT comprising a well-modulator quadrupole hereof can be located between the first and second, or between the second and third, quadrupoles in a QqQ mass spectrometer, or as or after the third quadrupole thereof. Typically, the well-modulator quadrupole-based LIT can be located between the final mass analyzing quadrupole (Q3) of a QqQ mass spectrometer and the exit lens thereof.

A well-modulator quadrupole can be constructed in various formats, such as a LIT quadrupole assemblage having one or more of: auxiliary electrodes, a segmented quadrupole rod-set, resistive coating(s), and combinations thereof.

In some embodiments hereof, the well-modulator quadrupole can comprise one or more sets of independently potentiated auxiliary electrodes. The auxiliary electrodes can have the form of auxiliary bars, auxiliary collars, or other formats. In various embodiments of an auxiliary electrode-supplemented linear ion trap, the auxiliary electrodes used in a given set of bars can have a cross section that is circular, elliptical, oval, hyperbolic, T-shaped, Y-shaped, wedge-shaped, teardrop-shaped, or any other geometry useful in the art of auxiliary electrodes. Where the auxiliary electrodes have a cross-section having a tapered end, such as the main leg of a T-shaped, or Y-shaped electrode, or the narrower-width portion of a ellipse, oval, wedge, or teardrop electrode, in various embodiments, that tapered end can be oriented toward the central axis of the linear ion trap, e.g., the central axis of a LIT quadrupole.

Where used, auxiliary electrodes are disposed in a regular distribution about the LIT, e.g., two or four to a set. Sets of four are typically used. In some embodiments, the auxiliary electrodes used in a given set can take the form of collars, each collar surrounding a segment of an LIT quadrupole rod and being potentiated independently thereof. Typically, when ceramic collars are used they have four conductive stripes along the length of the collar to which a potential can be applied. In embodiments in which a solid metal collar is used, then there is only one electrode; yet, the effect is the same as having four separate electrodes maintained at the same potential because the rods of the LIT shield the interior of the LIT (where the ions are stored) from the portions of the collar behind the rods. The bars or collars can be made of the same materials as, or a different material from, that of the LIT quadrupole rods. In some embodiments, two or more sets of auxiliary electrodes can be present in the well-modulator quadrupole. These can be disposed along separate or overlapping zones of the LIT quadrupole. Where more than one set of auxiliary electrodes is present, such sets can comprise electrodes of that have the same or different shape, size, or material composition between sets.

Thus, in some embodiments, a well-modulator quadrupole can be an assemblage comprising: (1) one quadrupole rod set and at least one set of four shorter auxiliary electrodes, shorter than the quadrupole rods, each shorter electrode being disposed substantially parallel to the other shorter electrodes in its set and each shorter electrode being located in a space between a different pair of rods of the quadrupole to form a short, linear region within the linear ion trap quadrupole; or (2) a segmented quadrupole of at least two segments; wherein each set of auxiliary electrodes of (1) or each segment of (2) is electrically potentiated independently of the remaining element(s) thereof, such that the quadrupole assemblage contains at least two independently potentiated zones. The different zones of the quadrupole assemblage are capable of being operated to form two or more potential wells within the linear ion trap of which it is a part. The potential wells can be formed alternately or simultaneously with one another, in at least two different sectors of the linear ion trap, with these sectors including a proximal sector (PS) nearer an ion source (A) for the linear ion trap, and a distal sector (DS) nearer an ion exit port (B) for the linear ion trap. The PS can be operated to form a PS well, and the DS can be operated to form a DS well. In various embodiments, the ion source (A) can be the quadrupole series of a mass spectrometer; and the ion exit port (B) can be a lens of a mass spectrometer. In operation in a mass spectrometer equipped with a well-modulator quadrupole linear ion trap, an ion population can be loaded from quadrupole series (A) into a well formed in the distal sector (DS) of the ion trap, and those distal sector-well-resident ions can then be transferred back to series (A) by passage through a well formed in the proximal sector (PS), with the proximal sector well retaining a fraction of those ions. This can be accomplished, e.g., by first forming a DS well, loading an ion population from the series (A) into the DS well, forming a PS well and increasing the potential of the DS to a level greater than that of the PS well and less than that of the exit lens; the ions can then be transferred back across the PS well into the appropriately potentiated series (A). Where the potential of the PS well has a "shallow" profile relative to its immediately surrounding potentials, it can retain a fraction of the ion population that is being passed across it from the DS well to series (A). Then the DS and PS potentials can be manipulated to transfer that fraction of ions from the PS well to a DS well prior to delivery to the exit lens (B). Alternatively, that fraction of the ion population can be further treated in the ion trap, e.g., by fragmentation, prior to delivery to the exit lens.

In some embodiments, a well-modulator quadrupole hereof can comprise a segmented LIT quadrupole that is separated into two or three or more segments. At least one such segment exhibits a different potential than that of other elements in the well-modulator quadrupole, e.g., is potentiated independently from other elements thereof.

In some embodiments, elements of the well modulator quadrupole, such as different sets of segments of a segmented LIT quadrupole or different sets of auxiliary electrodes can, while being potentiated independently of other elements of the LIT well-modulatory quadrupole, be co-potentiated with each other, whether through application of a common voltage from a single source or through otherwise being operated to exhibit the same potential.

In some embodiments hereof, the well-modulator quadrupole can comprise LIT quadrupole rod set in which rods thereof have a resistive coating applied to the surface of at least one segment thereof. For examples such a coating can be located on a lateral face of a rod, such as on part of the rod face that is oriented toward the central axis of the LIT, or can form a band around the radial surface of a segment of the rod. Other arrangements of resistive coatings can also be used, with the placement of the coating, for each coating in a set of coatings, being the same in terms of a regular, radial arrangement about the LIT.

In some embodiments, a resistive coating can comprise a glass, or other vitreous material, that is bonded to the rod surface. In some such embodiments, the resistive coating can be formed by annealing a coating material to the rod surface. In some embodiments, the coating material can be or comprise: a silicate glass; a leaded glass, e.g., $PbO—B_2O_3—Al_2O_3—SiO_2$; silicone carbide; or silicon nitride. In some embodiments, the coating can be formed from a mixture of metal oxide or carbon particles dispersed in a vitreous frit material. For example, this can be formed from a mixture of about 50% or less by weight of particulate metal oxide(s) and/or carbon, dispersed in a pre-glass particulate, such as of a silicate pre-glass. The metal oxide can be, e.g., any one of aluminum oxide ($Al_2O_3$), iron oxide ($Fe_2O_3$), titanium dioxide ($TiO_2$), cadmium oxide (CdO), chromium oxide ($Cr_2O_3$), copper oxide ($Cu_2O$, CuO), indium oxide ($In_2O_3$), or vanadium oxide ($V_3O_5$), mixed-metal oxides, e.g., titanium-chromium oxide ($TiCr_2O_4$), or a combination thereof; the carbon can be, e.g., graphite; and combinations thereof can be used. Useful resistive coatings also include those described, e.g., in U.S. Pat. No. 4,124,540 Foreman et al. and U.S. Pat. No. 5,746,635 to Spindt et al., herein incorporated by reference. In some embodiments, a coating can be formed from graphite, or from a mixture of metal oxide and graphite, e.g., a coating such as described in U.S. Pat. No. 3,791,546 to Maley et al., incorporate by reference herein.

In some embodiments, a combination of LIT quadrupole rod segmentation, auxiliary electrode supplementation, resistive coating, and/or other differently-potentiating format(s) can be used in a well-modulator quadrupole hereof. In any give zone, the electrodes of a given set of auxiliary electrodes, or the segments or resistively-coated elements of a given set of such segments or coated elements, are capable of being operated in a coordinated manner, and in a method hereof, are operated in such a manner, so as to form a higher-potential or lower-potential region within the LIT, relative to the potential of other elements of the LIT. A lower-potential region within such a zone can be referred to, in various embodiments hereof, as a well or a "potential well."

Any such embodiments can be used to provide differently potentiated zones in a LIT that define LIT sectors in which potential wells can be formed. When a well is formed according to various embodiments hereof, its potential is lower than that of the adjacent zones of the LIT. The difference is determined by the user to be large enough to retain a desired fraction of ions, yet small enough to allow excess ions to be returned to the upstream quadrupole series of a mass spectrometer, i.e. where the LIT is located downstream of a mass spectrometer quadrupole series. The difference in potential between the well and its adjacent zones will depend on the total charge to be retained in the well, which is dependent upon the number of ions and the charge of each ion. In various embodiments, the potential difference can typically be, e.g., about 500 mV to about 50 V; in some embodiments, this can be at least or about 1, 2, 5, or 10 V and up to or about 25, 20, or 15 V. 20V is a useful potential difference in some embodiments. The depth of the well that is created when 20 V (the potential applied to the linac electrodes in the experiments providing the data) is applied is about 0.06 V (delta V2 in FIG. 3B) at its deepest point. This is the on-axis DC potential created by the linac electrodes. The linac electrode is 10 mm from the central axis of the LIT at its closest point. (If the electrodes were closer thereto, then the on-axis DC potential would have been greater for the same 20 V applied to the linac electrodes.) The depth of the well should be sufficient to retain ions that are thermalised, which means the well should be at least 0.026 V deep. (0.026 eV corresponds to thermal energies). When the linac electrodes have a potential of 200 V applied, the on-axis potential is about 0.6 V (delta V1 in FIG. 3A), which is enough of a barrier to cause ions to be retained in the LIT under space charge conditions.

In embodiments employing a segmented LIT, the DC potentials applied to the segments would reflect a convolution of the DC potentials applied to the segments in the immediate vicinity, i.e. If the segment were relatively long, then the DC offset applied would be the height of the barrier (or depth of the well). If the segment were short, then the DC potential would be affected somewhat by its neighboring segments. Auxiliary electrodes employ more applied potential to produce the same on-axis potential that is found when a smaller potential is applied to a segmented LIT. Applying potentials to a segmented rod also preempts the issue of shielding of the potentials by the LIT rods when auxiliary electrodes are used. (However, the shielding becomes an issue only when the ions are at radial amplitudes of more than 50% of the field radius. As one of ordinary skill in the art understands, the choice of absolute voltages will depend upon the electrode set-up chosen to form the well. In various embodiments, the potential difference is also small enough to avoid causing fragmentation of ions during the transfer of excess ions out of the LIT. For purposes of achieving transfer of LIT-loaded ions back to the upstream (adjacent) part of a quadrupole series, in embodiments in which the well-modulator LIT is located following a mass spectrometer quadrupole series, the potential of that upstream, adjacent part can be lower than that of the linear ion trap by a potential difference that can be as discussed above for formation of potential wells in the LIT.

The depth of the trapping potential is controlled by the potential differences along the axis of the trap. A larger potential difference leads to a deeper potential well which holds more ions. The ability to adjust these potentials allows one to adjust the number of ions that a proximal well can hold. In operation, a user can perform a preliminary test to determine whether or not the effect of space charge were presenting a problem in a given analysis, i.e. whether or not the potential well were so deep that it retained too many ions for the desired analysis. If it were found to be a problem, then the user could, e.g., reduce the depth of a proximal well so that it holds a reduced number of ions that is appropriate for the analysis. In various embodiments, a potential well can be formed whose depth, relative to the potentials of the adjacent regions of the ion trap, is about or greater than 0.025 V or 0.026 V. In various embodiments, this depth can be about or greater than 0.03, 0.04, 0.05, 0.1, 0.2, 0.3, 0.4, or 0.5 V. In some embodiments, the well depth can be about or greater than 1 V. In various embodiments, the well depth can be about or less than 10, 5, 2, 1, 0.9, 0.8, 0.7, 0.6, or 0.5 V. Such a well is formed by maintaining its potential at a value that is lower than the potential(s) of the adjacent LIT regions.

In various embodiments, a LIT comprising a well-modulator quadrupole hereof can be located adjacent to the exit lens of a mass spectrometer. The exit lens is maintained at a potential that is greater than that of the elements of the LIT. The difference in potential between the exit lens and the adjacent LIT element is selected by the user as a value large enough to inhibit ions from exiting the lens until such exit is desired. Typically, the exit lens is from about 1 V to about 500 V greater than the elements of the LIT, or at least from the adjacent (upstream) LIT element. The potential on the exit lens, relative to the LIT potential offset, is greater than the axial kinetic energy of the ion when it enters the LIT. Typically, when the ion leaves the Q2 collision cell, it has been thermalised and leaves the collision cell with a very low kinetic energy (0.025 eV). The potential difference in the downstream optics then determine the ion's kinetic energy, with the potential offset of the LIT being the optic that matters most. Thus, the potential difference between the LIT and the Q2 collision cell is what determines the axial kinetic energy of the ion in the LIT. The exit lens has a potential applied to it to that is greater than this energy. In various embodiments, an exit lens potential of 200 V is useful simply because it is greater than the potential applied to the exit lens for any ions that are typically scanned out of the LIT, in many embodiments. Thus, the exit lens can be maintained at a potential that is, e.g., at least or about 5, 10, 20, 50, or 100 V and up to or about 500, 400, 300, or 250V greater than that of all, or at least the adjacent, LIT element(s); in various embodiments, this can be a difference of 200V. In general, the potential difference of the exit lens is set relatively higher, e.g., on the order of about 100 V or more.

Mass spectrometry methods hereof can, in various embodiments, involve: (a) providing a short linear ion trap between a Q3 rodset and an exit lens of a mass spectrometer; (b) providing ions into the short linear ion trap; (c) providing a first trapping region (small trapping potential) in the short linear ion trap; (d) accumulating ions in the first trapping region (small trapping potential); and (e) generating a second trapping region (Q3 region) as excess ions from the first trapping region (small trapping potential) move into the second trapping region (Q3 region). Such methods can further include a step of scanning out and detecting the ions in the first trapping region, i.e. which has a small trapping potential. Such methods can involve, in step (c), forming a first trapping region (small trapping potential) having a potential that is optimized to produce a potential well to contain a desired number of ions to produce a mass spectrum without space charge effects.

The LIT is filled for a period of time. FIG. 3A illustrates an embodiment at the point in time after the LIT has been filled for a period of time. After the filling step is completed, ions are no longer entering the quadrupole, e.g., until scanning is performed and further filling of the LIT is desired.

In various embodiments hereof, the excess ions that are returned to a quadrupole upstream from the LIT can be retained therein. In some embodiments, these can be re-loaded into the well-modulator quadrupole-based LIT for a subsequent round of treatment according to a method hereof, in order to remove excess ions. The fraction of re-loaded ions remaining in the LIT in the second round can then be scanned out for detection. Such rounds can be repeated as often as desired, using retained ions; this can be repeated until all of the excess ions of have been scanned out of the trap. This can permit mulitplicate, e.g., duplicate or triplicate, measurements of a sample, without requiring an additional step of loading a new population of ions into the mass spectrometer.

In various embodiments, a proximal well can be formed by decreasing the potential on a set of linac electrodes around the linear ion trap at the proximal end, while increasing the linear ion trap offset potential. The sum of the increased linear ion trap potential and the decreased linac electrodes' potential creates a well that is at a potential higher than that of the quadrupole. The same effect can alternatively be accomplished by lowering the quadrupole offset potential and the linac electrode potential.

Although the above embodiments are described with reference to the use of two different trapping regions, defined by different material constitutions of different LIT sections, alternative embodiments are also contemplated in which two different zones can be created simply by manipulating the axial potential in two different sections of the trapping quadrupole. Thus, in some alternative embodiments, the ions could first fill the LIT, e.g., as illustrated in FIG. 3A. Then a next step could be implemented to lower the barrier created by the T bars, linac electrodes, or other potentiated element(s) that is closest to the quadrupole, in order to form a small barrier instead of the well that is formed in FIG. 3B. This would leave a fraction of the ions trapped in the potential zone near the exit lens, while excess ions move to the upstream quadrupole (e.g., Q3), which is at a lower potential than the barrier or LIT potentials. A programmable controller, as described above, could readily be modified to be programmed for operation of such a simplified alternative method hereof.

In some alternative embodiments, the LIT can comprise a lens, e.g., an "entrance" lens, positioned proximal to the first quadrupole. Such a lens can serve as one of the two potential-manipulable zones of the well-modulator quadrupole hereof. In operation, the lens potential can be lowered to allow excess ions to transit back into the first quadrupole, thereby reducing the space charge. The remainder of the LIT can, in some such embodiments, serve as the other, differently potentiated zone.

In an embodiment including an entrance lens, after the ions have filled the linear ion trap, the potential on the lens could be raised to confine the ions in the linear ion trap section. The potential on the first quadrupole could then be lowered. Next the potential on the lens could be lowered to a potential just above the potential on the linear ion trap, thus forming a shallow well in the linear ion trap region. Excess ions can then flow out of the linear ion trap and back into the first quadrupole. The potential on the lens could then be raised in order to prevent ions from leaving or entering the linear ion trap. The ions in the linear ion trap are then mass-analyzed.

In such an embodiment, one of the elements of the LIT, other than a physical section of the quadrupole, serves as one of the two potential-manipulable zones of the well-modulator quadrupole. In some embodiments, instead of manipulating the potential of a lens, the potential of a set of auxiliary electrodes can be lowered, while desired ions are retained in the distal sector of the LIT, and the auxiliary electrode potential is lowered until the barrier is low enough to allow excess ions to transit back into the first quadrupole. The trapping potential remains in the distal sector in such an embodiment.

Similarly, in some alternative embodiments, the LIT exit lens can serve as one of the two potential-manipulable zones of the LIT; in operation in some embodiments, the exit lens can be manipulated to permit excess ions that have been loaded into the LIT to simply passed through the exit lens to decrease the space charge, and then ions remaining in the LIT can be scanned out. The remainder of the LIT can, in some such embodiments, serve as the other, differently potentiated zone.

In some embodiments hereof, such alternative feature(s), e.g., axial potential manipulation, "entrance lens" manipulation, and/or exit lens manipulation, can be used in conjunction with a well-modulator quadrupole LIT as described above.

EXAMPLES

Experimental. All experiments are carried out on a modified 4000 Q Trap (mass spectrometry system, from Applied Biosystems, Foster City, Calif., USA), using a short linear ion trap (SLIT) situated between the Q3 rod-set and the exit lens. This is illustrated in FIG. 1, along with the potentials applied to each optic during the fill step. The potential applied to the auxiliary electrode is 200 V during this step and produces an additional potential of ΔV1 along the axis of the SLIT. The ions are denoted by the +'s. During the filling of the SLIT, the potentials along the length of the ion path are adjusted to admit as many ions as possible into the SLIT. After the SLIT has been filled, the rod offset on the SLIT is raised to 0 V while the potential on Q3 is left low; see FIG. 2. This prevents energetic ions that are remaining in Q3 from transferring into the SLIT during the scanning out step. The ions are scanned out of the SLIT using the technique of mass selective axial ejection (MSAE), which is available on all of the Q Trap products. The ions are scanned out of the SLIT at q=0.85 using an ejection frequency of 312 kHz and a drive frequency of 816 kHz.

A standard tuning mixture (from Agilent Technologies, Santa Clara, Calif., USA) is used to supply ions for these experiments. Dilutions of 1:10, 1:100 and 1:1000 are used, as well as the undiluted sampled referred to as 1:1 in the Figures. Samples are infused at 7.0 μl/min. Fill times are varied from 0.3 ms to 1000 ms. Results are presented in FIGS. 4-6, with FIG. 6 demonstrating that various embodiments of the present method offer the ability to use survey scans under a wider range of sample concentrations and conditions. Embodiments of the present technology are adaptable for use with many different mass spectrometers and with other systems equipped with an ion trap.

The experimental set-up and the data shown are just one example of how the technique can be implemented. A weak trapping potential, within the main trapping potential, can be provided in a variety of ways, such as by use of a set of external (auxiliary) electrodes, a segmented rod set, and so forth. In one method, an attractive potential could be applied to the conductive stripes on the quadrupole support collar when ions are confined within the quadrupole. The next step is to provide an exit from the main trap for the excess ions to leave. The only ions remaining in the trap will be those contained in the weak trapping potential. After the excess ions have been removed, the potentials can then be re-established to bring the remaining ions to the conditions traditionally used during scanning of the ions out of the trap. The depth of the weak trapping potential can be optimized to produce a well that contains only a desired number of ions that is sufficient to produce a mass spectrum without the distorting effects of space charge.

What is claimed is:

1. A mass spectrometry apparatus, comprising a first quadrupole;

an exit lens; and a linear ion trap disposed between the first quadrupole and the exit lens, the linear ion trap having a well-modulator quadrupole comprising at least two differently potentiated zones, defining at least two different sectors of the linear ion trap such that the linear ion trap operates to form potential wells, alternately or simultaneously, in at least two different sectors of the linear ion trap, the sectors including a proximal sector nearer the first quadrupole and a distal sector nearer the exit lens, whereby an ion population is loaded from said first quadrupole into a well formed in said distal sector and, by manipulation of the potentials of differently potentiated zones of the well-modulator quadrupole, some of those ions are transferred back to said first quadrupole by passage through a well formed in said proximal sector, the proximal sector well retaining a fraction of those ions, thereby preventing overfilling of the linear ion trap.

2. The apparatus according to claim 1, further comprising a programmable controller operably coupled to the linear ion trap, and that is programmed with an algorithm comprising instructions for the controller to manipulate the potentials of the sectors of the linear ion trap, at levels below the potential of the exit lens, by:

(1) holding the linear ion trap at a potential lower than the potential of the first quadrupole and with a potential well at a distal sector of the linear ion trap that has a potential less than the potential of a proximal sector thereof, thereby permitting transfer of ions from the said first quadrupole to the linear ion trap;

(2) raising the potential of the linear ion trap to a level higher than the potential of the first quadrupole, and decreasing the potential of the proximal sector to form a proximal sector well defined in part by a higher potential wall at its upstream end, and (3) raising the potential of the distal sector well to a level that is about the same as or greater than that of the wall, thereby transferring ions from the distal sector well to said first quadrupole and transferring a fraction of the ions from the distal sector well to the proximal sector well.

3. The apparatus according to claim 2, wherein said algorithm further comprises instructions to:

(4) after step (3), raise the potential of the proximal sector, or decrease the potential of the distal sector, to transfer ions from the proximal sector to the distal sector.

4. The apparatus according to claim 3, wherein said algorithm further comprises instructions to:

(5) after step (4), scan ions out of the linear ion trap for detection at a detector.

5. The apparatus according to claim 2, wherein said algorithm further comprises instructions to repeat steps (1)-(3) to allow loading and processing of ions retained in the first quadrupole as a result of having been transferred back to there as a result of step (3).

6. The apparatus according to claim 2, wherein the programmable controller is further operably coupled to the first quadrupole, and the controller is programmed with an algorithm comprising instructions for the controller to manipulate the potential(s) thereof.

7. The mass spectrometry apparatus according to claim 1, wherein said well-modulator quadrupole comprises an auxiliary-electrode-supplemented quadrupole rod set having one trap quadrupole rod set and at least one set of four shorter auxiliary electrodes, shorter than the rods of said trap quadrupole, each shorter electrode being disposed substantially parallel to the other shorter electrodes of its set and being located in a space between a different pair of rods of the quadrupole, the shorter electrodes of a set being located axially equidistantly from the plane of the exit lens and radially equidistantly from the central axis of the trap quadrupole, to form a short, linear zone within the linear ion trap quadrupole, and each set of auxiliary electrodes being electrically potentiated independently of other elements of the linear ion trap, thereby defining said at least two differently potentiated zones along the trap quadrupole rod set.

8. The apparatus according to claim 7, wherein the auxiliary electrodes have a T-shaped cross-section.

9. The mass spectrometry apparatus according to claim 1, wherein said well-modulator quadrupole comprises a segmented quadrupole of at least two segments, wherein each segment is electrically potentiated independently of other elements of the linear ion trap, thereby defining said at least two differently potentiated zones along the segmented quadrupole.

10. The mass spectrometry apparatus according to claim 1, wherein (A) one of said two sectors is said exit lens or (B) the linear ion trap further comprises an entrance lens and one of said two sectors is said entrance lens.

11. A method for mass spectrometry, comprising (I) providing a mass spectrometry apparatus having a linear ion trap located between a first quadrupole of the device and the exit lens thereof, the linear ion trap comprising at least two sectors, including a proximal sector nearer said first quadrupole and a distal sector nearer said lens, each of the sectors being electrically potentiated differently from the other, (II) operating the mass spectrometer to transfer ions from the first quadrupole to the linear ion trap, (III) trapping transferred ions in a first sector of the linear ion trap that is maintained at a lower potential than that of the regions of the linear ion trap adjacent thereto, (IV) adjusting the potentials within the linear ion trap to transfer ions from the trapping sector to the adjacent first quadrupole and to retain a fraction of the ions in a second sector of said trap that is maintained at a lower potential than that of its adjacent regions in the linear ion trap, the second sector being the same or different from the first sector in step (III).

12. The method according to claim 11, wherein the transferring in step (II) involves maintaining the potentials of (1) the linear ion trap and (2) the portion of the first quadrupole that is adjacent to linear ion trap, so that said adjacent portion has a higher potential that than of linear ion trap.

13. The method according to claim 11, wherein the method further comprises (V) scanning the fraction of ions of step (IV) out of the linear ion trap and detecting ions released therefrom, the method thereby substantially reducing space charge interference in the detection of an ion of interest from the released ions.

14. The method according to claim 11, wherein, in step (IV), the second sector is different from the first sector.

15. The method according to claim 14, wherein, in step (IV), the second sector is a proximal sector and the first sector is a distal sector of the linear ion trap.

16. The method according to claim 11, the ions transferred in step (IV) from the trapping segment of linear ion trap to the first quadrupole being retained therein, wherein the method further comprises transferring retained ions, after the linear ion trap has been scanned to empty it of ions, to the linear ion trap and repeating steps (III) and (IV).

17. The method according to claim 16, wherein the method further comprises (V) scanning the fraction of ions of step (IV) out of the linear ion trap and detecting ions released therefrom, the method thereby substantially reducing space charge interference in the detection of an ion of interest from the released ions.

18. The method according to claim 11, wherein the manipulating in step (IV) involves adjusting the potential of the linear ion trap, the potential of the portion of the first quadrupole that is adjacent to linear ion trap, or adjusting both, so that the adjacent portion has a lower potential that than of linear ion trap.

19. The method according to claim 11, wherein, after the adjustment of the potential(s), the potential of the adjacent portion of the first quadrupole is at least 500 mV lower than that of the linear ion trap.

20. The method according to claim 19, wherein, after the adjustment of the potential(s), the potential of the adjacent portion of the first quadrupole is about 20 V or more lower than that of the linear ion trap.

21. The method according to claim 11, wherein the exit lens is maintained at a potential that is sufficiently greater than that of the potential of the remaining elements of the linear ion trap such that ions are inhibited from exiting the linear ion trap prematurely.

22. The method according to claim 21, wherein the exit lens is maintained at a potential that is about 200 V greater that the potential of the linear ion trap.

23. The method according to claim 11, wherein the mass spectrometry apparatus comprises a triple quadrupole mass spectrometer and said first quadrupole comprises Q3.

24. The method according to claim 11, wherein the first sector of step (III) or the second sector of step (IV) is maintained at a potential that is at least or about 0.05 V lower than the adjacent regions of the linear ion trap.

25. The method according to claim 11 wherein (A) one of said two sectors is said exit lens or (B) the linear ion trap further comprises an entrance lens and one of said two sectors is said entrance lens.

* * * * *